US011441106B2

(12) United States Patent
Danzer

(10) Patent No.: US 11,441,106 B2
(45) **Date of Patent: *Sep. 13, 2022**

(54) PARTICULATE FRAGRANCE ENHANCERS

(71) Applicant: Henkel AG & Co. KGaA, Duesseldorf (DE)

(72) Inventor: Leland M. Danzer, Chandler, AZ (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/635,161

(22) Filed: Jun. 27, 2017

(65) Prior Publication Data

US 2018/0371378 A1 Dec. 27, 2018

(51) Int. Cl.

| | |
|---|---|
| ***C11D 3/50*** | (2006.01) |
| ***C11D 3/00*** | (2006.01) |
| ***C11D 3/30*** | (2006.01) |
| ***C11D 3/20*** | (2006.01) |
| ***C11D 17/00*** | (2006.01) |
| ***C11D 1/62*** | (2006.01) |
| ***C11D 3/22*** | (2006.01) |
| ***C11D 11/00*** | (2006.01) |

(52) U.S. Cl.

CPC ..... *C11D 3/505* (2013.01); *C11D 1/62* (2013.01); *C11D 3/001* (2013.01); *C11D 3/2096* (2013.01); *C11D 3/227* (2013.01); *C11D 3/30* (2013.01); *C11D 3/50* (2013.01); *C11D 11/0088* (2013.01); *C11D 17/0039* (2013.01)

(58) Field of Classification Search

None

See application file for complete search history.

(56) References Cited

U.S. PATENT DOCUMENTS

| | | | |
|---|---|---|---|
| 387,052 | A | 7/1888 | Cliff |
| 3,226,329 | A | 12/1965 | Kilmer-MacMillan |
| 3,415,758 | A | 12/1968 | Powell et al. |
| 3,455,838 | A | 7/1969 | Marotta et al. |
| 3,516,941 | A | 6/1970 | Matson |
| 3,686,025 | A | 8/1972 | Morton |
| 3,861,870 | A | 1/1975 | Edwards et al. |
| 3,870,542 | A | 3/1975 | Ida et al. |
| 3,886,075 | A | 5/1975 | Bernardino |
| 3,915,882 | A | 10/1975 | Nirschl et al. |

(Continued)

FOREIGN PATENT DOCUMENTS

| | | | |
|---|---|---|---|
| DE | 19620792 | A1 | 11/1997 |
| DE | 102006047230 | A1 | 4/2008 |

(Continued)

OTHER PUBLICATIONS

EP Search Report, PCT/US2018038767, Completed: Feb. 8, 2021, 14 pages.

(Continued)

*Primary Examiner* — Katie L. Hammer

(74) *Attorney, Agent, or Firm* — St. Onge Steward Johnston & Reens LLC

(57) ABSTRACT

A particulate fragrance enhancer can include a first fragrance, a fabric softening agent, a coating agent, and a particulate core. The first fragrance, fabric softening agent, and coating agent can be coated onto the particulate core to form the particulate fragrance enhancer.

20 Claims, 1 Drawing Sheet

(56) References Cited

U.S. PATENT DOCUMENTS

| | | | | |
|---|---|---|---|---|
| 3,974,076 | A | 8/1976 | Wiersema et al. | |
| 4,233,164 | A | 11/1980 | Davis | |
| 4,234,627 | A | 11/1980 | Schilling | |
| 4,237,016 | A | 12/1980 | Rudkin et al. | |
| 4,308,151 | A | 12/1981 | Cambre | |
| 4,406,816 | A | 9/1983 | Sliwka | |
| 4,446,032 | A * | 5/1984 | Munteanu | C11D 3/505 428/905 |
| 4,464,271 | A * | 8/1984 | Munteanu | A61K 8/11 510/521 |
| 5,066,419 | A | 11/1991 | Walley et al. | |
| 5,206,019 | A | 4/1993 | Nichols | |
| 5,591,707 | A * | 1/1997 | Raehse | B01D 1/18 159/47.1 |
| 5,880,086 | A * | 3/1999 | Weinelt | C11D 1/835 510/289 |
| 6,025,319 | A * | 2/2000 | Surutzidis | C11D 3/505 510/438 |
| 6,403,543 | B1 | 6/2002 | George | |
| 6,894,019 | B2 | 5/2005 | Oki et al. | |
| 6,951,836 | B2 | 10/2005 | Jahns et al. | |
| 7,166,567 | B2 * | 1/2007 | Schudel | A61Q 19/10 510/441 |
| 7,871,976 | B1 | 1/2011 | Aouad | |
| 8,399,395 | B2 | 3/2013 | Dreja et al. | |
| 9,011,887 | B2 | 4/2015 | Chieffi et al. | |
| 9,040,474 | B2 | 5/2015 | Alain Creutz et al. | |
| 2002/0187911 | A1 | 12/2002 | Liew | |
| 2003/0092600 | A1 | 5/2003 | Shepherd, Jr. | |
| 2005/0276831 | A1 * | 12/2005 | Dihora | A61K 8/11 424/401 |
| 2006/0073206 | A1 * | 4/2006 | Hoffmann et al. | C11D 17/0039 |
| 2007/0111919 | A1 | 5/2007 | Boerefijn et al. | |
| 2008/0131695 | A1 | 6/2008 | Aouad et al. | |
| 2009/0042766 | A1 | 2/2009 | Mayer et al. | |
| 2009/0082244 | A1 | 3/2009 | Mayer et al. | |
| 2009/0247446 | A1 | 10/2009 | Barthel et al. | |
| 2011/0097369 | A1 | 4/2011 | Sunder | |
| 2011/0123582 | A1 * | 5/2011 | Smets | A61K 8/11 424/401 |
| 2012/0220515 | A1 * | 8/2012 | Fernandes | C11D 17/0039 510/343 |
| 2014/0044761 | A1 | 2/2014 | Lei et al. | |
| 2015/0250689 | A1 * | 9/2015 | Dardelle | B01J 13/10 510/130 |

FOREIGN PATENT DOCUMENTS

| | | | |
|---|---|---|---|
| DE | 102012218690 | A1 | 4/2014 |
| EP | 0026914 | A1 | 4/1981 |
| EP | 0061296 | A1 | 9/1982 |
| EP | 0881279 | A2 | 12/1998 |
| EP | 1214892 | A1 | 6/2002 |
| EP | 1244768 | A2 | 10/2002 |
| EP | 1715030 | A1 | 10/2006 |
| EP | 1881059 | A1 | 1/2008 |
| EP | 2291504 | B1 | 11/2012 |
| EP | 3181674 | A1 | 6/2017 |
| FR | 2725456 | A1 | 4/1996 |
| GB | 1464616 | A | 2/1997 |
| WO | WO 98/12298 | A2 | 3/1998 |
| WO | WO 02/44310 | A2 | 6/2002 |
| WO | WO 2004/020566 | A1 | 3/2004 |
| WO | WO 2005/059083 | A1 | 6/2005 |
| WO | WO 2005/097962 | A1 | 10/2005 |
| WO | WO 2007/014601 | A1 | 2/2007 |
| WO | WO 2007/113069 | A1 | 10/2007 |
| WO | WO 2007/113326 | A1 | 10/2007 |
| WO | WO 2007/115870 | A1 | 10/2007 |
| WO | WO 2007/115872 | A1 | 10/2007 |
| WO | WO 2007/130685 | A1 | 11/2007 |
| WO | WO 2008/040620 | A1 | 4/2008 |
| WO | WO 2008/104240 | A1 | 9/2008 |
| WO | WO 2010/000558 | A1 | 1/2010 |
| WO | WO 2011/131412 | | 10/2011 |
| WO | 2013036662 | A1 | 3/2013 |
| WO | WO 2013/036662 | | 3/2013 |
| WO | 20180148020 | A1 | 8/2018 |

OTHER PUBLICATIONS

PCT Application No. PCT/US2018/038767; filed Jun. 21, 2018; Henkel IP & Holding GMBH; International Search Report dated Oct. 12, 2018; 14 Pages.

Gordon et al.; "The Chemist's Companion: A Handbook of Practical Data, Techniques, and References"; (1972); pp. 30-36; John Wiley & Sons.

Murugan et al.; "Predicting Physical Properties from Molecular Structure"; ChemTech; (Jun. 1994); pp. 17-23; American Chemical Society.

Stanton et al.; "Computer-Assisted Prediction of Normal Boiling Points of Pyrans and Pyrroles"; Journal of Chemical Information and Computer Sciences; (Jul. 1992); pp. 306-316; vol. 32, No. 4; American Chemical Society; <doi: 10.1021/ci00008a009 >.

Stanton et al.; "Computer-Assisted Prediction of Normal Boiling Points of Furans, Tetrahydrofurans, and Thiophenes"; Journal of Chemical Information and Computer Sciences; (May 1991); pp. 301-310; vol. 31, No. 2; American Chemical Society; <doi: 10.1021/ci00002a017 >.

Taylor et al.; "vol. 4: Computer-Assisted Drug Design"; Comprehensive Medicinal Chemistry II; (2007); p. 295; $2^{nd}$ edition.

* cited by examiner

PARTICULATE FRAGRANCE ENHANCERS

BACKGROUND

In textile washing, it is often desirable to include a fragrance to impart a pleasant scent to the washing or rinsing bath, as well as to the textile items being cleaned. To this end, many textile care compositions include a fragrance as a basic ingredient. The ability of the textile care composition to impart a pleasant scent to textiles can be an important feature to consumers when selecting a specific product. However, in some cases, the textile care composition may not include a fragrance, or may only be able to include small amounts of fragrance, which are inadequate to impart the desired scent to the textile items. In such cases, a supplemental fragrance enhancer can be added to the washing or rinsing during the cleaning process.

BRIEF DESCRIPTION OF FIGURES

Invention features and advantages will be apparent from the detailed description which follows, taken in conjunction with the accompanying drawings, which together illustrate, by way of example, various invention embodiments; and, wherein.

Figure 1:
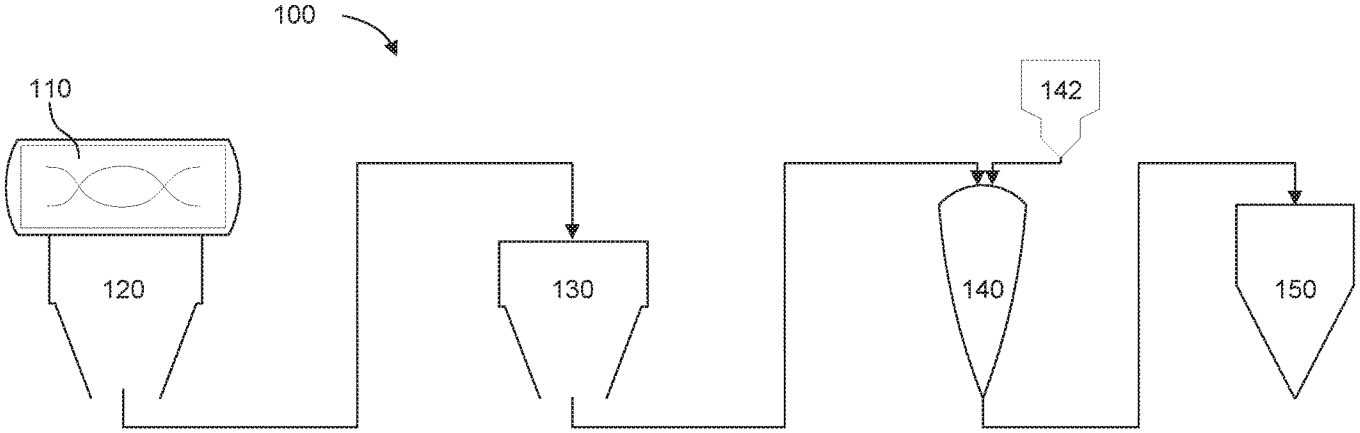
FIG. 1 depicts a schematic of an exemplary manufacturing process for producing a particulate fragrance enhancer in accordance with an invention embodiment.

Reference will now be made to the exemplary embodiments illustrated, and specific language will be used herein to describe the same. It will nevertheless be understood that no limitation of the scope or to specific invention embodiments is thereby intended.

DESCRIPTION OF EMBODIMENTS

Although the following detailed description contains many specifics for the purpose of illustration, a person of ordinary skill in the art will appreciate that many variations and alterations to the following details can be made and are considered to be included herein. Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

As used in this written description, the singular forms "a," "an" and "the" include express support for plural referents unless the context clearly dictates otherwise. Thus, for example, reference to "a polymer" or "the polymer" can include a plurality of such polymers.

In this application, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," in this written description it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of"substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about". For example, for the sake of convenience and brevity, a numerical range of "about 50 angstroms to about 80 angstroms" should also be understood to provide support for the range of "50 angstroms to 80 angstroms." Furthermore, it is to be understood that in this specification support for actual numerical values is provided even when the term "about" is used therewith. For example, the recitation of "about" 30 should be construed as not only providing support for values a little above and a little below 30, but also for the actual numerical value of 30 as well.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Reference in this application may be made to compositions, systems, or methods that provide "improved" or "enhanced" performance. It is to be understood that unless otherwise stated, such "improvement" or "enhancement" is a measure of a benefit obtained based on a comparison to compositions, systems or methods in the prior art. Furthermore, it is to be understood that the degree of improved or enhanced performance may vary between disclosed embodiments and that no equality or consistency in the amount, degree, or realization of improvement or enhancement is to be assumed as universally applicable.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

EXAMPLE EMBODIMENTS

An initial overview of invention embodiments is provided below and specific embodiments are then described in further detail. This initial summary is intended to aid readers in understanding the technological concepts more quickly, but is not intended to identify key or essential features thereof, nor is it intended to limit the scope of the claimed subject matter.

The present disclosure is drawn to particulate fragrance enhancers and methods of manufacturing particulate fragrance enhancers. In some embodiments, a particulate fragrance enhancer can include a first fragrance, a fabric softening agent, a coating agent, and a particulate core. The first fragrance, fabric softening agent, and coating agent can be coated onto the particulate core to form the particulate fragrance enhancer.

In some examples, a method of manufacturing a particulate fragrance enhancer can include coating a particulate core with a coating agent, a first fragrance, and a fabric softening agent in a mixing vessel to form the particulate fragrance enhancer.

Fragrance enhancers can generally be employed to impart a scent to textile materials. In some cases, a particular textile care composition can lack a fragrance, can lack sufficient fragrance, or can lack a fragrance of choice to be able to impart a desired scent to textile materials. In such cases, it can be desirable to use a fragrance enhancer in combination with the textile care composition to impart a desired and/or adequate fragrance to the textile materials.

In addition to imparting fragrance to the textile materials, it can also be desirable to impart other benefits to the textile materials via the fragrance enhancer. For example, fabric softening agents are often added separately to the wash bath during the wash and/or rinse cycle to coat the surface of the textile to impart a softer feel to the textile.

Adding a fabric softening agent to a particulate fragrance enhancer can be challenging. For example, many fabric softening agents are solids at room temperature. Thus, adding a fabric softening agent to a particulate fragrance enhancer that is typically manufactured at room temperature can, in some cases, require substantial modifications to the manufacturing process and additional manufacturing equipment. This can represent a significant investment of both time and resources to adapt a manufacturing process for a particulate fragrance enhancer to accommodate a fabric softening agent. In some additional examples, increasing the temperature of the manufacturing process can also induce premature volatilization of fragrance during manufacturing, which can necessitate significant fragrance overages to compensate for the losses.

The present particulate fragrance enhancer and associated methods of manufacturing can help overcome these challenges. In further detail, the particulate fragrance enhancer can include a first fragrance and a fabric softening agent. In some embodiments, the first fragrance can be a non-encapsulated fragrance, but encapsulation of the first fragrance can be employed in some examples. Fragrances are well known in the art and the first fragrance can include any suitable fragrance or combination of fragrances. For example, fragrances can include any suitable perfume, cologne, fragrance oil, essential oil, the like, or combinations thereof. The fragrance can be formulated to have a variety of suitable top notes, middle notes, bottom notes, or combinations thereof. In short, there are many fragrances and fragrance combinations that can be used in the particulate fragrance enhancer.

In some specific examples, the first fragrance can be or can include a perfume. Any suitable perfume can be used in the particulate fragrance enhancer. The term "perfume" can refer to a variety of suitable perfume oils, fragrances, and odorants. Individual odorant compounds, e.g. the synthetic products of the ester, ether, aldehyde, ketone, alcohol, and hydrocarbon types, can be used as perfume oils or fragrances. Odorant compounds of the ester type are, for example, benzyl acetate, phenoxyethyl isobutyrate, p-tert-butyl cyclohexyl acetate, linalyl acetate, dimethyl benzyl carbinyl acetate (DMBCA), phenyl ethyl acetate, benzyl acetate, ethyl methyl phenyl glycinate, allyl cyclohexyl propionate, styrallyl propionate, benzyl salicylate, cyclohexyl salicylate, floramate, melusate, jasmecyclate, or the like. The ethers include, for example, benzyl ethyl ether, ambroxan, or the like; the aldehydes, for example, the linear alkanals having 8 to 18 carbon atoms, citral, citronellal, citronellyl oxyacetaldehyde, cyclamenaldehyde, lilial, bourgeonal, or the like; the ketones, for example, the ionones, O-isomethyl ionone, methyl cedryl ketone, or the like; the alcohols, anethol, citronellol, eugenol, geraniol, linalool, phenylethyl alcohol, terpineol, or the like; and the hydrocarbons can include terpenes such as limonene, pinene, or the like. Thus, various mixtures of different odorants can be used in combination to produce an attractive fragrance note or combination of fragrance notes.

In some embodiments, the first fragrance can have a flash point of at least 140° F., but fragrances having a flash point below 140° F. can also be suitable in some instances. In some examples, the first fragrance can have a flash point of at least 160° F. or at least 180° F. In some specific examples, the first fragrance can have a flash point of from about 185° F. to about 212° F.

The first fragrance can be present in the particulate fragrance enhancer in a variety of amounts. The specific amount can depend on a number of factors, such as the type of fragrance employed, the desired potency of the fragrance, and the like. In some examples, the first fragrance can be present in the particulate fragrance enhancer in an amount from about 0.1 wt % to about 6 wt %. In yet other examples, the first fragrance can be present in the particulate fragrance enhancer in an amount from about 0.5 wt % to about 4 wt %, or from about 1 wt % to about 3 wt %.

As previously discussed, a fabric softening agent can also be included in the particulate fragrance enhancer to impart a softening benefit to textile materials. A variety of fabric softening agents can be employed. In some specific examples, the fabric softening agent can be a liquid at room temperature. In other words, in some examples, the fabric softening agent can have a melting point of less than or equal to about 68° F. to about 72° F. This can facilitate manufacturing of the particulate fragrance enhancer at approximately room temperature. In yet other examples, the fabric softening agent can be a solid at room temperature. Where the fabric softening agent is a solid at room temperature, in some examples, it can be dispersible or soluble in a suitable dispersing agent or solvent at approximately room temperature to facilitate the incorporation of the fabric softening agent in the particulate fragrance enhancer without increasing the temperature of the manufacturing process above about room temperature. Such dispersing agents or solvents can include a sugar alcohol and/or polyol (e.g. those useful as a coating agent), short chain alcohols (e.g. methanol, ethanol, isopropanol, etc.), acetone, ethyl acetate, any other suitable solvent, or combinations thereof. In yet other examples, where the fabric softening agent is a solid at room temperature, the fabric softening agent can be suitable to be dusted, adhered, or otherwise disposed, onto the particulate core at approximately room temperature to prepare the particulate fragrance enhancer without pre-dispersing the fabric softening agent in a dispersing agent or solvent.

A variety of fabric softening agents can be used. Non-limiting examples can include a variety of esterquats, cationic polysaccharides, imidazolium compounds, other suitable fabric softening agents, or combinations thereof. A variety of fabric softening agents are discussed in U.S. Pat. Nos. 3,861,870, 3,886,075, 3,974,076, 4,233,164, 4,237,016, and 4,308,151, each of which is incorporated by reference. Some specific, but non-limiting, examples of fabric softening agents can include tallow trimethyl ammonium chloride, ditallow dimethyl ammonium chloride, ditallow dimethyl ammonium methyl sulfate, dihexadecyl dimethyl ammonium chloride, di(hydrogenated tallow) dimethyl ammonium chloride, dioctadecyl dimethyl ammonium chloride, dieicosyl dimethyl ammonium chloride, didocosyl dimethyl ammonium chloride, di(hydrogenated tallow) dimethyl ammonium methyl sulfate, dihexadecyl diethyl ammonium chloride, dihexadecyl dimethyl ammonium acetate, ditallow dipropyl ammonium phosphate, ditallow dimethyl ammonium nitrate, di(coconut-alkyl) dimethyl ammonium chloride, 1-methyl-1-(tallowylamido-)ethyl-2-tallowyl-4,5-dihydroimidazolinium methosulfate, 1-methyl-1-(palmitoylamido)ethyl-2-octadecyl-4,5-dihydroimidazolinium chloride, 2-heptadecyl-1-methyl-1-(2-stearylamido)-ethyl-imidazolinium chloride, 2-lauryl-1-hydroxyethyl-1-oleyl-imidazolinium chloride, di-(oleyl carboxyethyl) hydroxyethyl methylammonium methosulfate, N,N'-di(alkylcarboxyethyl)-N-hydroxyethyl-N-methylammonium methyl sulfate, di-(palm carboxyethyl) hydroxyethyl methylammonium methosulfate, 1-Octadecanaminum-N,N-dimethyl-N-octadecyl-chloride, the like, or combinations thereof.

In some specific examples, the fabric softening agent can include a quaternary ammonium compound having a structure according to Formula I:

(I)

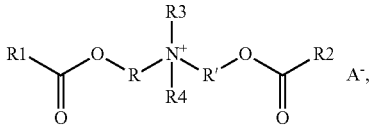

where R and R' are independently selected from a methyl, ethyl, or propyl group, R1 and R2 are independently selected from a saturated or unsaturated $C_{14}$-$C_{20}$ alkyl group, R3 is selected from a methyl, ethyl, or propyl group, R4 is selected from hydroxymethyl, hydroxyethyl, or hydroxypropyl groups, and $A^-$ is selected from a halide, sulfate, methyl sulfate, ethyl sulfate, or the like. In some examples, R and R' are an ethyl group. In some additional examples, R1 and R2 are independently selected from saturated or unsaturated $C_{16}$ or $C_{18}$ fatty acids. In additional examples, R3 is a methyl group. In additional examples, R4 is a hydroxyethyl group. In yet additional examples, $A^-$ is methyl sulfate.

In additional examples, the fabric softening agent can include a cationic polysaccharide as described in U.S. Pat. No. 9,040,474, which is incorporated herein by reference. In some specific examples, the fabric softening agent can include a cationic polysaccharide having a structure according to Formula II:

(II)

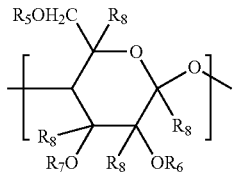

where $R_5$, $R_6$, and $R_7$ are independently selected from hydrogen (H), a linear or branched, substituted or unsubstituted $C_1$-$C_{24}$ alkyl group, or a group having a structure according to Formula III:

(III)

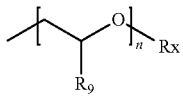

where n is an integer from 0 to 10, $R_9$ is selected from H, a substituted or unsubstituted $C_1$-$C_6$ alkyl group, or the like, Rx is H, a linear or branched, substituted or unsubstituted $C_1$-$C_{24}$ alkyl group, a group having a structure according to Formula IV:

(IV)

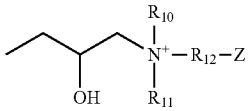

or mixtures thereof, where Z is a water soluble anion, such as a halide, hydroxide, phosphate, sulfate, methyl sulfate, ethyl sulfate, or acetate, for example, $R_{10}$, $R_{11}$, and $R_{12}$ are independently selected from H, a linear or branched, substituted or unsubstituted $C_1$-$C_{28}$ alkyl group, a benzyl group, a substituted benzyl group, or the like, and $R_8$ is H or —$(P)_m$—H, or combinations thereof, where P is a repeat unit of an addition polymer formed by a cationic monomer and m is an integer from 1 to 100. In some examples, the cationic monomer can be methacrylamidotrimethylammonium chloride, dimethyl diallyl ammonium having a structure according to Formula V:

(V)

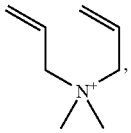

the like, or combinations thereof. In some examples, the cationic polysaccharide can have a weight average molecular weight (Mw) of from about 50,000 to about 4,000,000, or from about 100,000 or 200,000 to about 4,000,000.

Thus, a variety of fabric softening agents can be included in the particulate fragrance enhancers, including suitable combinations of any of the fabric softening agents described above, or the like.

The fabric softening agent can be incorporated in the particulate fragrance enhancer in a variety of amounts, depending on the particular application. In some specific examples, the fabric softening agent can be included in the particulate fragrance enhancer in an amount from about 0.1 wt % to about 10 wt %. In some other examples, the fabric softening agent can be included in an amount from about 0.5 wt % to about 8 wt %. In yet other examples, the fabric softening agent can be included in an amount from about 1 wt % to about 5 wt %.

The coating agent of the particulate fragrance enhancer can be used to help bind the first fragrance, the fabric softening agent, and any other desirable components to the particulate core. Any suitable coating agent can be used. Non-limiting examples can include propylene glycol, glycerol, butylene glycol, xylitol, sorbitol, mannitol, maltitol, polyethylene glycol, other polyols, other sugar alcohols, the like, or combinations thereof. In some examples, the coating agent can be a liquid at room temperature (e.g. about 68° F. to about 72° F.). In other examples, the coating agent can be a solid at room temperate. Where the coating agent is a solid at room temperature, the coating agent can be further dissolved in a suitable solvent or can be melted prior to application to the particulate core.

The coating agent can be applied in a variety of amounts depending on the type of coating agent, the type and amount of additional components applied to the particulate core, and the like. In some specific examples, the coating agent can be present in the particulate fragrance enhancer in an amount from about 0.001 wt % to about 2 wt %. In yet other examples, the coating agent can be present in an amount from about 0.01 wt % to about 1 wt %, or from about 0.05 wt % to about 0.5 wt %.

The particulate core can be made of a variety of materials. Non-limiting examples can include inorganic alkali metal salts, organic alkali metal salts, inorganic alkaline earth metal salts, organic alkaline earth metal salts, organic acid particles, carbohydrates, silicates, urea and mixtures thereof. For example, the particulate core can include sodium chloride, potassium chloride, sodium sulfate, sodium carbonate, potassium sulfate, potassium carbonate, sodium hydrogen carbonate, potassium hydrogen carbonate, sodium acetate, potassium acetate, sodium citrate, sodium tartrate, potassium sodium tartrate, calcium chloride, magnesium chloride, calcium lactate, citric acid, tartaric acid, water glass, sodium silicate, potassium silicate, urea, dextrose, fructose, galactose, isoglucose, glucose, saccharose, raffinose, isomalt, the like, or mixtures thereof.

In some examples, the particulate core can have a particle size of from about 0.5 mm to about 5 mm. However, in other examples, the particulate core can have a particle size of from about 0.5 mm to about 1.7 mm, or from about 1.6 mm to about 2.4 mm. The particulate core can be present in the particulate fragrance enhancer in an amount of from about 70 wt % to about 99 wt %. However, in some examples, the particulate core can be present in an amount of from about 80 wt % to about 97 wt %, or from about 85 wt % to about 95 wt %.

In some additional examples, the particulate fragrance enhancer can include a second fragrance. The second fragrance can also include any suitable perfume, cologne, fragrance oil, essential oil, the like, or combinations thereof. For example, any of the fragrance components described above with respect to the first fragrance can also be included in the second fragrance. In some examples, the first fragrance and the second fragrance can include or be the same fragrance. In some other examples, the first fragrance or the second fragrance can include different fragrances. In some embodiments, the second fragrance can include from about 5 wt % to about 30 wt % of a fragrance component. In other examples, the fragrance component can be present in an amount of from about 10 wt % to about 25 wt % of the second fragrance.

Further, in some embodiments, the second fragrance can be an encapsulated fragrance. Encapsulation of the second fragrance can help preserve or extend the lifetime of the fragrance imparted to a particular textile from the particulate fragrance enhancer. In further detail, the second fragrance can include from about 70 wt % to about 95 wt % encapsulating polymer. In yet other examples, the second fragrance can include from about 75 wt % to about 85 wt % encapsulating polymer.

A variety of encapsulating polymers can be used to encapsulate the fragrance components of the second fragrance. Non-limiting examples can include gelatin, starch, melamine-urea-formaldehyde, melamine-formaldehyde, urea-formaldehyde, an acrylate polymer, a vinyl polymer, the like, or a combination thereof. In some examples, the resulting microcapsule can be water-soluble. In yet other examples, the microcapsule can be water insoluble. Further, the second fragrance can have a particle size of from about 10 microns to about 180 microns. However, in other examples, the second fragrance can have a particle size of from about 10 microns to about 100 microns.

The second fragrance can be present in the particulate fragrance enhancer in an amount from about 0.1 wt % to about 5 wt %. In yet other examples, the second fragrance can be present in the particulate fragrance enhancer in an amount from about 0.3 wt % to about 3 wt %, or from about 0.5 wt % to about 2.5 wt %. However, the ratio of the first fragrance to the second fragrance can vary depending on a variety of factors, such as desired fragrance blend, desired initial fragrance imparted to the textile, desired lifetime of the fragrance imparted to the textile, and the like. In some specific examples, the first fragrance and the second fragrance can be present in the particulate fragrance enhancer at a weight ratio of from about 1:4 to about 3:1. In yet other examples, the first fragrance and the second fragrance can be present in the particulate fragrance enhancer at a weight ratio of from about 1:3 to about 3:1, or from about 1:2 to about 2:1.

A variety of additional components can also be included in the particulate fragrance enhancer. Non-limiting examples can include a colorant, a corrosion inhibitor, a processing aid, an aversive agent, an anti-static agent, an odor absorbing agent, a color stability agent, the like, or combinations thereof. However, in some examples, the particulate fragrance enhancer is free of or substantially free of a surfactant.

In some specific examples, the particulate fragrance enhancer can include a processing aid or flow aid. The processing aid can be incorporated into the formulation to aid in the manufacturing process. In some examples, the processing aid can improve the conveying characteristics of the particulate fragrance enhancer, or various components thereof, during the manufacturing process, whether the product is mechanically, pneumatically, or otherwise conveyed. In some examples, the processing aid can prevent excess coating agent from coating the manufacturing equipment. In some additional examples, the processing aid can facilitate removal of the particulate fragrance enhancer from a product container. In some further examples, the processing aid can help prevent coated or uncoated particulate core particles from sticking together or agglomerating via the adsorption or absorption of moisture. A variety of processing aids can be included in the particulate fragrance enhancer. Non-limiting examples can include stearates, silicates, fumed silicas, precipitated silicas, talc, encapsulated fragrances, powdered salts, the like, or combinations thereof. Where included, the processing aid can typically be present in an amount from about 0.05 wt % to about 5 wt %. In yet other examples, the processing aid can be present in an amount from about 0.1 wt % to about 3 wt %. In some examples, the amount of processing aid incorporated into the particulate fragrance enhancer can be based on angle of repose. As is understood by one skilled in the art, angle of repose relates to the steepest angle from horizontal at which the particulate fragrance enhancer can be piled without slumping. In some examples, the processing aid can be included in the particulate fragrance enhancer in an amount to provide the particulate fragrance enhancer with an angle of repose from about 20 degrees to about 45 degrees. In some additional examples, the processing aid can be included in the particulate fragrance enhancer in an amount to provide the particulate fragrance enhancer with an angle of repose from about 25 degrees to about 35 degrees.

The present disclosure also describes methods of manufacturing a particulate fragrance enhancer. In one example, the method can include coating a particulate core with a coating agent, a first fragrance, and a fabric softening agent in a mixing vessel to form the particulate fragrance enhancer. In some examples, the coating agent, the first fragrance, and the fabric softening agent can be introduced separately into the mixing vessel to coat the particulate core. In some examples, the coating agent can be introduced into the mixing vessel prior to the first fragrance and the fabric softening agent. Where this is the case, the first fragrance and the fabric softening agent can be introduced contemporaneously or sequentially, as desired. In other examples, the coating agent can be introduced into the mixing vessel contemporaneously with the first fragrance, the fabric softening agent, or both.

In yet other examples, the coating agent can be combined with one or more additional components to form a pre-mix composition prior to coating the particulate core. For example, in some cases, the pre-mix composition can include a colorant, an aversive agent (e.g. a denatonium compound, or the like), and/or other suitable components. Further, in some examples, the pre-mix composition can include the first fragrance. In yet other examples, the pre-mix composition can include the fabric softening agent. However, if the viscosity of the pre-mix composition gets too large, the coating process can become challenging. Thus, where a pre-mix composition is used, the pre-mix composition can typically have a viscosity of from about 5 centipoise (cps) to about 200 cps. In yet other examples, the pre-mix composition can have a viscosity of from about 5 cps to about 45 cps. In some specific examples, the coating agent and the first fragrance can be combined into a pre-mix composition prior to applying to the particulate core, whereas the fabric softening agent can be applied independently of and subsequently to the pre-mix composition including the coating agent and the first fragrance.

Whether the coating agent, the first fragrance, and the fabric softening agent are added separately or combined in a pre-mix composition prior to coating, the coating agent, the first fragrance, and the fabric softening agent can be coated or applied onto the particulate core using a variety of methods. In one example, one or more of the coating agent, the first fragrance, and the fabric softening agent can be sprayed onto the particulate core. Where this is the case, the addition rate, number of addition nozzles, mixing rate during addition, duration of mixing after coating, and other conditions can be optimized to minimize the amount of time it takes to achieve even coating of the particulate core. In yet other examples, one or more of the coating agent, the first fragrance, and the fabric softening agent can be added to the mixing vessel without spraying, such as by dusting, pouring, or the like. In such cases, the mixing process itself can be optimized to minimize the amount of time to achieve an even coating of the particulate core.

With specific reference to coating the particulate core with the fabric softening agent, in some examples, this can be performed at room temperature. For example, in some cases, the fabric softening agent can be a liquid at room temperature. In yet other examples, the fabric softening agent can be a solid at room temperature, but can be dispersible or soluble in a suitable dispersing agent or solvent at room temperature. In yet other examples, the fabric softening agent can be melted prior to coating the particulate core with the fabric softening agent. In still other examples, the fabric softening agent can be dusted, adhered, or otherwise disposed onto the particulate core.

In some further examples, coating of the particulate core can also include introducing a corrosion inhibitor, a processing aid, an aversive agent, an anti-static agent, an odor absorbing agent, a color stability agent, the like, or combinations thereof into the mixing vessel with the coating agent, the first fragrance, the fabric softening agent, and the particulate core to form the particulate fragrance enhancer. In some examples, one or more of these agents can also be included in a pre-mix composition, where desirable. In some examples, the pre-mix composition can be a pre-mix composition that includes the coating agent. In some other examples, the pre-mix composition can be a pre-mix composition, or a second pre-mix composition, that does not include the coating agent, but can optionally include any other suitable combinations of components. Thus, the various components described herein can be added separately, or in various combinations of pre-mix compositions, to form the particulate fragrance enhancer.

The mixing vessel used in the manufacturing process can include a variety of suitable mixing vessels. Non-limiting examples can include a plow mixer, a ribbon mixer, a spiral mixer, a paddle mixer, a drum mixer, a v-blender, a conical screw mixer, or the like.

In some examples, a second fragrance can be applied to the particulate core. The second fragrance can be applied to the particulate core in a number of ways. For example, in some cases, the second fragrance can be applied to the particulate core after it has been coated with the coating agent. Further, in some examples, the manufacturing process can be performed without melting the particulate core or any other components that amount to 5% or 10% or more of the particulate fragrance enhancer, such that the second fragrance is not embedded within a molten composition to protect the microcapsules from breakage during the manufacturing process. Nonetheless, the method of applying the second fragrance to the coated particulate core can be performed in a manner to minimize breakage of the polymeric encapsulation of the second fragrance. For example, in some cases, the method of applying the second fragrance can be performed in a manner such that the encapsulation of less than or equal to 50%, 40%, 35%, 30%, 25%, or 20% of the second fragrance is broken. In some specific examples, the second fragrance can be applied to the coated particulate core in combination with a processing aid or flow aid.

In one specific example, the second fragrance can be applied to the coated particulate core by combining the second fragrance and the coated particulate core in a conical mixer, or equivalent. In some examples, the mixing parameters can be adjusted depending on the fragility of the polymeric encapsulation used for the second fragrance. In some examples, the second fragrance and the coated particulate core can be mixed for a period of from about 1 minute or 2 minutes to about 8 minutes, 9 minutes, or 10 minutes.

Further, the conical mixer can employ a swing arm and/or a screw. The swing arm can be operated at a variety of speeds. In some specific examples, the swing arm can be operated at a mixing speed of from about 0.5 rpm to about 5 rpm, or from about 1 rpm to about 3 rpm. The screw can also be operated at a number of mixing speeds. In some specific examples, the screw can be operated at a mixing speed of from about 10 rpm to about 100 rpm, or from about 20 rpm to about 80 rpm.

An example manufacturing process 100 employing a conical mixer is generally illustrated in FIG. 1. The coating agent, first fragrance, fabric softening agent, and particulate core can be mixed in a mixing vessel 110 to form a particulate fragrance enhancer or coated particulate core. The coated particulate core can be transferred to a surge hopper 120 and conveyed to a silo/finished product hopper 130. The coated particulate core can then be transferred to a conical mixer 140. A second fragrance can also be transferred from a storage container 142 to the conical mixer 140. The coated particulate core and the second fragrance are mixed in the conical mixer 140 to form the particulate fragrance enhancer. The particulate fragrance enhancer can then be transferred to a filler 150.

In yet another example, the second fragrance can be applied to the coated particulate core on a conveyor via a vibratory feeder. In some examples, the second fragrance and the coated particulate core can be further conveyed to a filler auger that further mixes the second fragrance and coated particulate core to form the particulate fragrance enhancer. While the filler auger can be operated at a number of mixing speeds, in some examples, the filler auger can have a mixing speed of from about 5 revolutions per minute (rpm) to about 50 rpm. In yet other examples, the filler auger can be have a mixing speed of from about 30 rpm to about 50 rpm.

Figure 2:
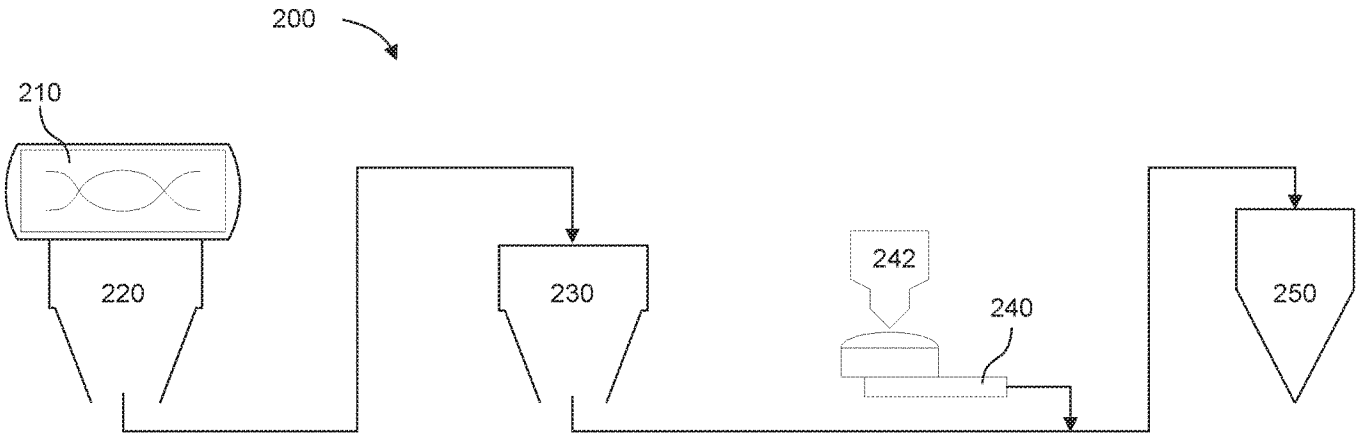
FIG. 2 depicts a schematic of an exemplary manufacturing process in for producing a particulate fragrance enhancer in accordance with another invention embodiment.

An example manufacturing process 200 employing a vibratory feeder is generally illustrated in FIG. 2. The coating agent, first fragrance, fabric softening agent, and particulate core can be mixed in a mixing vessel 210 to form a particulate fragrance enhancer or coated particulate core. The coated particulate core can be transferred to a surge hopper 220 and conveyed to a silo/finished product hopper 230. The coated particulate core can then be transferred on a conveyor towards a filler 250. A second fragrance can be metered from a storage container 242 via a vibratory feeder 240 onto the conveyor prior to the coated particulate core arriving at the filler 250. The coated particulate core and the second fragrance can be mixed as the second fragrance is metered onto the conveyor via the vibratory feeder 240 and further mixed in the filler 250 to form the particulate fragrance enhancer.

EXAMPLES

Example 1—Manufacture of a Particulate Fragrance Enhancer Including a Fabric Softening Agent A pre-mix composition was prepared at room temperature including a coating agent, colorant, fragrance, and fabric softening agent as listed in Table 1.

TABLE 1

| Component | Amount |
|---|---|
| Propylene Glycol (Coating Agent) | 4 wt % |
| Fragrance | 39.9 wt % |
| Fabric Softening Agent (REWOQUAT ® WE 45 from Evonik ™) | 55.8 wt % |
| Colorant | 0.3 wt % |

The pre-mix composition was then sprayed into a mixing vessel to coat a sodium chloride particulate core. A processing aid and corrosion inhibitor were also added in the mixing vessel and coated onto the particulate core. The final composition is recited in Table 2 below:

TABLE 2

| Component | Amount |
|---|---|
| Particulate Core (Sodium Chloride Salt) | 89.5 wt % |
| Pre-Mix Composition | 6.25 wt % |
| Corrosion Inhibitor (Sodium Silicate) | 4 wt % |
| Processing Aid (Fumed Silica) | 0.25 wt % |

Example 2—Fabric Softening Comparative Study

A variety of particulate fragrance enhancers were prepared with and without a fabric softening agent. The particulate fragrance enhancer without a fabric softening agent was used as a control. Further, a liquid fabric softening composition was also used as a comparative example. Three lots of particulate fragrance enhancers were prepared with a fabric softening agent at approximately 1.5 wt % fabric softening agent (Sample 1), 3 wt % fabric softening agent (Sample 2), and 4.5 wt % fabric softening agent (Sample 3), respectively.

Each of the samples were introduced into a washing basin during a wash cycle to determine the extent to which the various components imparted a softening effect to the tested textiles. Each of the textiles were scored by a panel of analysts to determine the level of softness where 0 indicates no imparted softness and 8 indicates a high level of softness. The average results are illustrated in Table 3 below:

TABLE 3

| Sample | Average Fabric Softness Score |
|---|---|
| Particulate Fragrance Enhancer w/o Fabric Softening Agent (Control) | 1.95 |
| Liquid Fabric Softener | 4.95 |
| Sample 1 | 1.90 |
| Sample 2 | 2.10 |
| Sample 3 | 2.33 |

As illustrated in Table 3, Sample 1 did not provide a softening benefit that was distinguishable from the Control. In contrast, Sample 2 and Sample 3 each provided a softening benefit that was distinguishable from the Control.

Example 3—Addition of Second Fragrance Via a Conical Screw Mixer

The first fragrance and coating agent were combined with the particulate core in the main mixing vessel and then transferred to a VRIECO-NAUTA® conical screw mixer where the encapsulated fragrance was added. The conical screw mixer was operated with a variety of mixing parameters to determine the percent breakage of the polymeric encapsulation at the various mixing parameters. The results are summarized in Table 4 below:

TABLE 4

| Run | Mix Time (Minutes) | Motor (Hz) | % Encap Breakage | Swing Arm (RPM) | Screw (RPM) |
|---|---|---|---|---|---|
| 1 | 5 | 40 | 33 | 2.2 | 60 |
| 2 | 5 | 40 | 36 | 2.2 | 60 |
| 3 | 5 | 40 | 34 | 2.2 | 60 |

TABLE 4-continued

| Run | Mix Time (Minutes) | Motor (Hz) | % Encap Breakage | Swing Arm (RPM) | Screw (RPM) |
|---|---|---|---|---|---|
| 4 | 5 | 40 | 35 | 2.2 | 60 |
| 5 | 2 | 55 | 28 | 3.0 | 82.5 |
| 6 | 1 | 40 | 20 | 2.2 | 60 |
| 7 | 5 | 40 | 35 | 2.2 | 60 |
| 8 | 5 | 40 | 35 | 2.2 | 60 |
| 9 | 5 | 40 | 35 | 2.2 | 60 |
| 10 | 9 | 40 | 48 | 2.2 | 60 |
| 11 | 2 | 25 | 19 | 1.4 | 37.5 |
| 12 | 5 | 61 | 44 | 3.3 | 91.8 |
| 13 | 8 | 25 | 33 | 1.4 | 37.5 |
| 14 | 8 | 55 | 48 | 3.0 | 82.5 |
| 15 | 5 | 40 | 40 | 2.2 | 60 |
| 16 | 5 | 19 | 23 | 1.0 | 28.2 |

As can be seen in Table 4, there are a number of mixing parameters that can be employed using a conical mixer to add an encapsulated fragrance to the particulate fragrance enhancer that can minimize the amount of encapsulation breakage (i.e. maximize the number or amount of intact capsules) of the encapsulated fragrance. In each case, the amount of encapsulation breakage was reduced to below 50% breakage (i.e. capsulation integrity or intact capsules was maintained above 50%). In other cases, the encapsulation breakage was reduced to levels even below 20% breakage (i.e. capsulation integrity or intact capsules was maintained above 80%).

Example 4—Addition of Second Fragrance Via a Vibratory Feeder

The first fragrance and coating agent were combined with the particulate core in the main mixing vessel and then transported on a conveyor toward the filler. While en route to the filler, an encapsulated fragrance was deposited onto the conveyor with the coated particulate core. The encapsulated fragrance and coated particulate core were conveyed to a filler auger, where further mixing of the encapsulated fragrance and the coated particulate core occurred. The filler auger was operated at about 30 rpm to about 50 rpm. Due to the minimal amount of shear imparted to the second fragrance using this method, it was observed that there was a 70-93% survival rate of the polymeric encapsulation after filling.

It should be understood that the above-described methods are only illustrative of some embodiments of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that variations including, may be made without departing from the principles and concepts set forth herein.

What is claimed is:

1. A particulate fragrance enhancer, comprising:

a first fragrance;

an esterquat, cationic polysaccharide, or imidazolium fabric softening agent;

a water-soluble coating agent, said water-soluble coating agent being a liquid at a temperature of from about 68° F. to about 72° F.; and a particulate core, wherein the first fragrance, the fabric softening agent, and the water-soluble coating agent are combined in a premix prior to being coated onto the particulate core, wherein the first fragrance, the fabric softening agent, and the water-soluble coating agent are coated onto the particulate core at the same time.

2. The particulate fragrance enhancer of claim 1, wherein the first fragrance is present in the particulate fragrance enhancer in an amount from about 0.1 wt % to about 6 wt %.

3. The particulate fragrance enhancer of claim 1, wherein the fabric softening agent is present in the particulate fragrance enhancer in an amount from about 0.1 wt % to about 10 wt %.

4. The particulate fragrance enhancer of claim 1, wherein the fabric softening agent has a melting point of less than or equal to 68° F.

5. The particulate fragrance enhancer of claim 1, wherein the fabric softening agent comprises a compound having a structure according to Formula I:

(I)

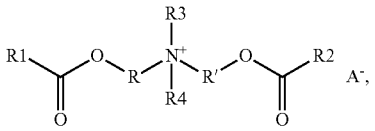

where R and R' are independently selected from a methyl, ethyl, or propyl group, R1 and R2 are independently selected from a saturated or unsaturated $C_{14}$-$C_{20}$ alkyl group, R3 is selected from a methyl, ethyl, or propyl group, R4 is selected from hydroxymethyl, hydroxyethyl, or hydroxypropyl groups, and $A^-$ is selected from a halide, sulfate, methyl sulfate, or ethyl sulfate.

6. The particulate fragrance enhancer of claim 1, wherein the fabric softening agent comprises a compound having a structure according to Formula II:

(II)

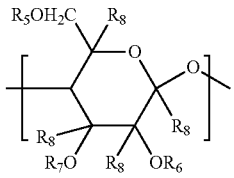

where $R_5$, $R_6$, and $R_7$ are independently selected from:

hydrogen (H), a linear or branched, substituted or unsubstituted $C_1$-$C_{24}$ alkyl group, or a group having a structure according to Formula III:

(III)

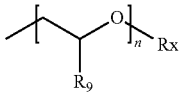

where n is an integer from 0 to 10, $R_9$ is selected from H or a substituted or unsubstituted $C_1$-$C_6$ alkyl group, and Rx is H, a linear or branched, substituted or unsubstituted $C_1$-$C_{24}$ alkyl group, or a group having a structure according to Formula IV:

(IV)

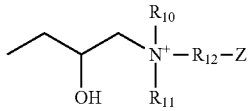

where Z is a water soluble anion selected from a halide, hydroxide, phosphate, sulfate, methyl sulfate, ethyl sulfate, or acetate, and $R_{10}$, $R_{11}$, $R_{12}$ are independently selected from H, a linear or branched, substituted or unsubstituted C1-C28 alkyl group, a benzyl group, or a substituted benzyl group, and R8 is H, —(P)m-H, or a combination thereof, where P is a repeat unit of an addition polymer formed by a cationic monomer selected from methacrylamidotrimethylammonium chloride, a dimethyl diallyl ammonium having a structure according to Formula V:

(V)

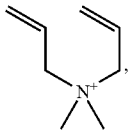

or combinations thereof, and m is an integer from 1 to 100.

7. The particulate fragrance enhancer of claim 1, wherein the water-soluble coating agent is present in the particulate fragrance enhancer in an amount from about 0.001 wt % to about 2 wt %.

8. The particulate fragrance enhancer of claim 1, wherein the particulate core is present in the particulate fragrance enhancer in an amount from about 70 wt % to about 99 wt %.

9. The particulate fragrance enhancer of claim 1, wherein the particulate core has a particle size of from about 0.5 mm to about 5 mm.

10. The particulate fragrance enhancer of claim 1, further comprising a second fragrance coated over the particulate core having the first fragrance, the fabric softening agent, and the water-soluble coating agent coated onto it, said second fragrance being an encapsulated fragrance.

11. The particulate fragrance enhancer of claim 10, wherein the first fragrance and the second fragrance are present at weight ratio of from about 1:4 to about 3:1.

12. The particulate fragrance enhancer of claim 10, wherein the second fragrance has a particle size of from about 10 microns to about 180 microns.

13. A method of manufacturing a particulate fragrance enhancer, comprising:

combining a first fragrance, a fabric softening agent, and a water-soluble coating agent in a premix, wherein the water-soluble coating agent is a liquid at a temperature of from about 68° F. to about 72° F.; and coating a particulate core with the premix of the first fragrance, the fabric softening agent, and the water-soluble coating agent in a mixing vessel to form the particulate fragrance enhancer.

14. The method of claim 13, wherein the coating comprises spraying the water-soluble coating agent, the first fragrance, the fabric softening agent, or a combination thereof onto the particulate core.

15. The method of claim 13, wherein the coating further comprises applying a corrosion inhibitor, a processing aid, or a combination thereof to the particulate core in the mixing vessel to form the particulate fragrance enhancer.

16. The method of claim 13, wherein the mixing vessel is a member selected from the group consisting of: a plow mixer, a ribbon mixer, a spiral mixer, a paddle mixer, a v-blender, a conical screw mixer, and a drum mixer.

17. The method of claim 13, further comprising applying a second fragrance onto the coated particulate core to form the particulate fragrance enhancer, said second fragrance being an encapsulated fragrance.

18. The method of claim 17, wherein the applying is performed by adding the second fragrance to the coated particulate core on a conveyor via a vibratory feeder.

19. The method of claim 17, wherein the applying is performed by combining the second fragrance and the coated particulate core in a conical mixer.

20. The method of claim 13, wherein the fabric softening agent is an esterquat, cationic polysaccharide, or imidazolium.

* * * * *